US006058503A

United States Patent [19]

Williams

[11] Patent Number: 6,058,503

[45] Date of Patent: May 9, 2000

[54] ARTICULATED JOINT PROTECTOR

[76] Inventor: David Williams, 7533 Briar Rose, Houston, Tex. 77063

[21] Appl. No.: 09/045,011

[22] Filed: Mar. 20, 1998

[51] Int. Cl.[7] ..... A41D 13/08

[52] U.S. Cl. ..... 2/16; 2/24

[58] Field of Search ..... 2/455, 16, 22, 2/23, 24, 2.5; 602/6, 12, 20, 26

[56] References Cited

U.S. PATENT DOCUMENTS

| | | | |
|---|---|---|---|
| 1,243,230 | 10/1917 | Smith | 602/6 |
| 2,652,565 | 9/1953 | MacLellan | 2/24 |
| 3,587,572 | 6/1971 | Evans | 602/26 |
| 3,712,299 | 1/1973 | Voehl | 128/80 |
| 3,742,517 | 7/1973 | Bednarczuk et al. | 2/24 |
| 3,928,872 | 12/1975 | Johnson | 2/22 |
| 3,942,522 | 3/1976 | Wilson | 602/6 |
| 3,945,047 | 3/1976 | Jarrell, Jr. | 2/24 |
| 4,198,708 | 4/1980 | Fugere et al. | 2/16 |
| 4,292,263 | 9/1981 | Hanrahan et al. | 264/46.9 |
| 4,474,573 | 10/1984 | Detty | 128/80 |
| 4,484,361 | 11/1984 | Leighton et al. | 2/24 |
| 4,490,855 | 1/1985 | Figgie, III et al. | 2/24 |
| 4,756,026 | 7/1988 | Pierce, Jr. | 2/16 |
| 4,796,303 | 1/1989 | Atwater | 2/24 |
| 4,905,681 | 3/1990 | Glascock | 2/22 |
| 4,914,753 | 4/1990 | Chang | 2/24 |
| 4,922,929 | 5/1990 | DeJournett | 128/892 |
| 5,168,576 | 12/1992 | Krent et al. . | |
| 5,255,391 | 10/1993 | Levine | 2/24 |
| 5,500,955 | 3/1996 | Gongea | 2/24 |
| 5,634,211 | 6/1997 | Chen | 2/22 |
| 5,717,996 | 2/1998 | Feldman | 2/22 |
| 5,794,261 | 8/1998 | Hefling | 2/16 |

FOREIGN PATENT DOCUMENTS

| | | | |
|---|---|---|---|
| 92013250 | 8/1992 | WIPO | 2/2.5 |
| 92016813 | 10/1992 | WIPO | 2/2.5 |

*Primary Examiner*—Michael A. Neas

[57] ABSTRACT

Elbow and knee guards are used in sports in which the athlete must expect regular contact with the ground or floor. This guard utilizes hinged resilient members along the lateral direction of the joint and sliding slots which allow the guard to both rotate and deflect along the longitudinal direction. As the knee or elbow is flexed, the skin stretches in the longitudinal direction carrying the resilient members along and consequently the guard stretches and changes its shape to match the shape of the limb. The aluminum hinges allow the joint to flex in the lateral direction. The guard does not don the limb and thus eliminates chafing. The guard is placed over the knee or elbow. By pressing on the guard with the hands, the aluminum hinges will deform until the guard conforms to the contour of the surface.

2 Claims, 4 Drawing Sheets

ARTICULATED JOINT PROTECTOR

BACKGROUND—FIELD OF INVENTION

This invention relates to protective equipment for athletes and specifically to knee and elbow guards.

BACKGROUND—DESCRIPTION OF PRIOR ART

Elbow and knee guards are used in sports in which the athlete must expect regular contact with the ground or floor. The knee and elbow of an amateur athlete receive the bulk of the impact because of the natural instinct to break the fall using our arms and legs. Professional ice skaters and small children will usually fall on their gluteus maximus to prevent injuring these sensitive joints. Heretofore, elbow and knee guards have been attached to elastic fabric which dons the joint while some utilize a tubular elastic element configured to fit over the joint. Others use straps to secure the guard to the joint. Commercially available limb protecting devices are usually constructed of an elastic cloth covering a protective panel constructed of either a flexible resilient polymer foam pad or a rigid polymeric plastic panel that is conformed to the surface of the limb to be protected. These panels are either flat to cover a small portion of the limb or are curved to shape around a portion of the limb surface.

Some of the more common donned devices using elastic fabric are described in DeJournett(1990), 4,922,929, Krent (1992), 5,168,576, and Jarrell(1976), 3,945,047. Protectors that use a tubular elastic element are described in Atwater (1989), 4,796,303, Leighton(1984) 4,484,361, Pierce(1988), 4,756,026, Detty(1984), 4,474,573, Hanrahan(1981), 4,292, 263, and Bednarczuk(1973), 3,742,517. Staps holding the device in place are described in Figgie(1985), 4,490,855, Chang(1990), 4,914,753, Voehl(1973), 3,712,299, Levine (1993), 5,255,391, and Gongea(1996), 5,500,955, Fugere (1980), 4,198,708.

These devices provide minimal protection for the joint over which they are positioned and little protection for the sides of the joint. Further, these innovations restrict the movement of the joint, crawl along the limb with use, smother the area to be protected, and chafe the skin particularly behind the joint. The objective when designing a limb guard is to eliminate or reduce the aforementioned onerous qualities.

Many of these devices use a rigid plastic material or foam as a cushioning medium. The use of foam or rigid plastic material to cover the knee cap or elbow is unsatisfactory. Albeit the rigid plastic material will protect the joint from scrapes and cuts, the rigid material is unable to absorb the energy of impact which is transferred to the joint. As Table 1 shows, rubber with its large energy per unit weight would be an ideal choice for knee and elbow guards. Rubber also has the added advantage of rapid recovery.

The guards designed heretofore crawl or shift with respect to the joint. The reason for this is the difference in the elasticity of the fabric and the elasticity of the skin; the skin being more flexible than the fabric. As the joint moves from fully extended to fully bent, the corresponding points between the fabric and the skin move relatively to each other and as this process is irreversible and the joint is cycled many times in the activity, the joint guard shifts relative to the joint. Designers have tried to overcome this problem by bonding the guard to the limb. This is accomplished by increasing the tension in the straps or decreasing the flexibility of the elastic fabric. This causes the guard to act as a tourniquet and causes discomfort to the user.

TABLE 1

| Material | Specific Gravity | E lb per sq in | Elastic Limit lb per sq in | w in-lb per in cu | w1 in-lb per lb |
|---|---|---|---|---|---|
| Steel | 7.8 | 30 E 6 | 30000 | 15. | 53. |
| Hard Plastic | 1.27 | 480000 | 15200 | 240. | 5236. |
| Rubber | .93 | 150. | 300. | 300. | 8900. |

The previous contraptions don the limb with material. The bending of the knee pleats the material behind the joint which chafes the skin. To eliminate this onerous effect, the material behind the joint should be removed. Removing material will also cause the limb guard to be less restrictive.

Most commercially available limb guards blanket the joint with a non-hydrophobic material with the result that the guard becomes saturated with perspiration. The high absorption rate of the material gives the user a malodorous soggy sensation.

OBJECTS AND ADVANTAGES

This limb guard has numerous advantages. First, the guard provides protection for the knee or elbow by using a resilient material. The resilient material cushions the knee cap, the side of the joint, the lower part of the thigh, and upper part of the calf. The guard is adjustable to varying lateral dimensions. Individual limb sizes normally vary near (3) nominal values (see Humanscale 7/8/9 by Niels Diffrient and others. Humanscale 7/8/9 is a registered trademark). This limb guard can be made to accommodate these (3) nominal sizes by varying the number of subassemblies. This limb guard does not have material behind the joint which can pleat and cause irritation to the limb. As the joint cycles between its extreme positions, this guard is able to conform to the changing contour without using restrictive and binding elastic material. This guard has a tiled pattern with gaps between the boundaries which allows the skin to breathe.

DRAWING FIGURES

REFERENCE NUMERALS IN DRAWING

Figure 1:
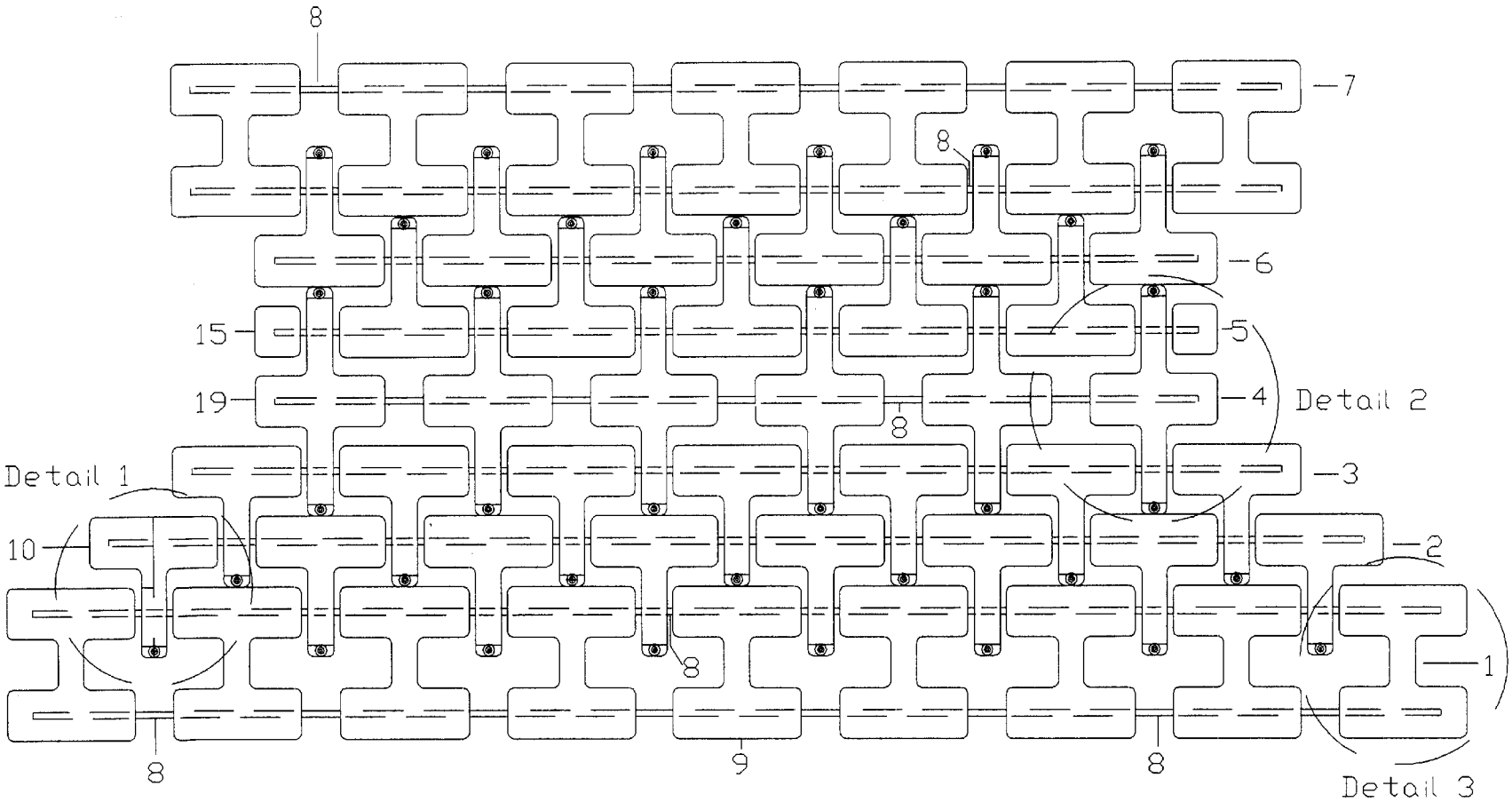
FIG. 1 is a plan view of the limb guard.

1 Subassembly 1
2 Subassembly 2
3 Modified subassembly 2
4 Subassembly 3
5 Modified subassembly 2
6 Modified subassembly 2
7 Modified subassembly 1
8 1/16 inch aluminum rod
9 Element of subassembly 1
10 Element of subassembly 2
11 Lower jaw 12 Upper jaw
13 Anchor pin
14 Hole
15 Nub of modified subassembly 2
16 Bill of anchor pin Item 13
17 Crown of anchor pin Item 13
19 Element of subassembly 3
20 Surface representing the knee, upper calf, and lower thigh

DESCRIPTION FIG. 1 THROUGH FIG. 6

Figure 3:
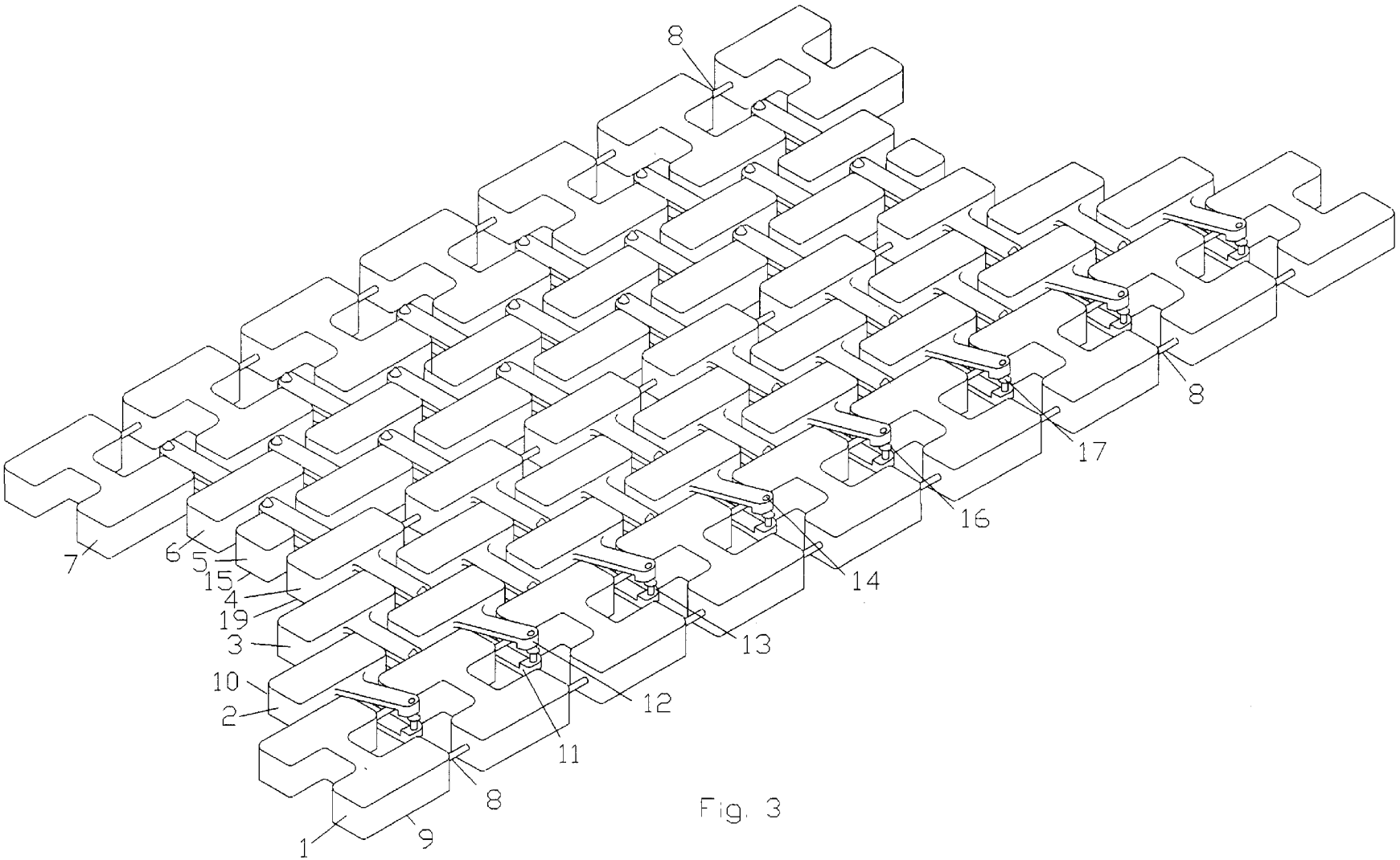
FIG. 3 is an isometric view of the assembled limb guard.

Referring to FIG. 3, the limb guard shown is assembled from (3) silicone rubber subassemblies. To shape a material such as silicone, a mold must be made. Production molds are very expensive and in order to keep production costs low, this guard requires only (3) molds. One reason molds are so expensive is the complexity of the mold cavity. The limb guard might have been cast as one single unit but as FIG. 3 reveals, the mold cavity would be very complex in shape. An alternative would be to use (3) subassemblies Item 1, Item 2, and Item 4 and then assemble the guard from these subassemblies. A subassembly is a collection of elements or units working together to accomplish a desired objective which is to build a limb guard that is flexible, comfortable, and economically feasible. Subassembly 1 Item 1 of FIG. 3 has (9) elements Item 10. This subassembly could be cast from a mold having say (12) elements and then cut to the required length. Item 7 with (7) elements is made in the same way. The number of elements for each subassembly has been arbitrarily chosen. The actual number will depend on the range of sizes the guard will cover. The length of the guard can be increased or decreased by adding or subtracting subassemblies. The width can be increased or decreased by the addition or subtraction of elements. Progressing from Item 1 to Item 7, the lateral lengths of these items shorten to accommodate the varying lateral dimension of the limb. The varying lateral dimension helps the limb guard assume the shape of the bent joint. As mentioned above, average limb sizes usually fall into (3) categories. One of the important features of this limb guard is the ability to manufacture various guard sizes from (3) molds.

The subassemblies of this guard are made using the injection molding process. Injection molding is a process where thermoplastic molding compounds are plasticized in an appropriate heating cylinder, then forced by plunger action through one or more orifices into a relatively cool mold where the material solidifies to the desired shape. The mold cavity is divided into (2) parts which are held together by a hydraulic ram. After the material solidifies, the mold cavity is parted and the silicone profile is removed. The mold is then closed and process is repeated. Referring to FIG. 1 and FIG. 3, all the subassemblies have one or more aluminum rods or tubes Item 8 encapsulated by the silicone. The mold cavity will assume the shape of the profile to be cast and will have slots that will receive and position the rod in the center of the silicone profile. After the mold is parted and the last silicone profile is removed, the rod is placed in the slots. The mold is closed and the injection process begins.

Figure 2:
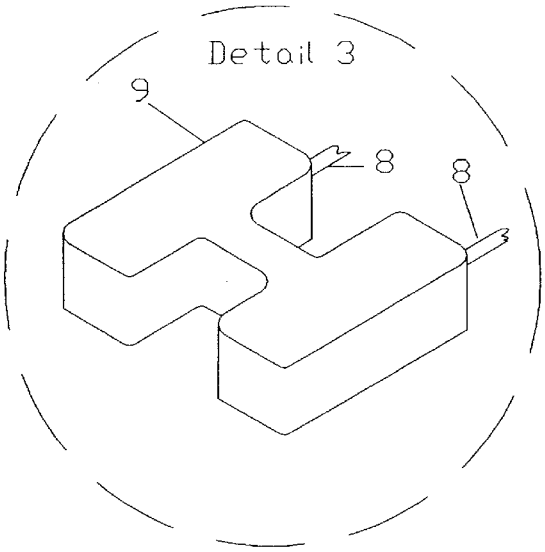
FIG. 2 is a detail of an element of subassembly 1 Item 1.

Referring to FIG. 2, a removed element Item 9 of subassembly 1 Item 1 is depicted to show the (2) aluminum rods and to show the profile of the subassembly after it is removed from the mold. The mold for this subassembly would require (2) pairs of slots to position the aluminum rods in the center of the profile.

Figure 4:
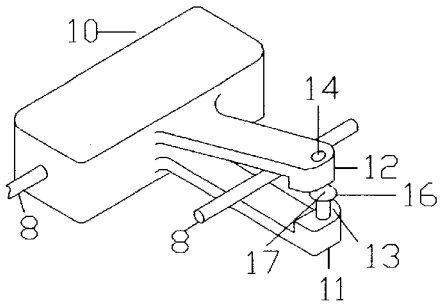
FIG. 4 is a detail of an element of subassembly 2 Item 2 in the open position.
Figure 6:
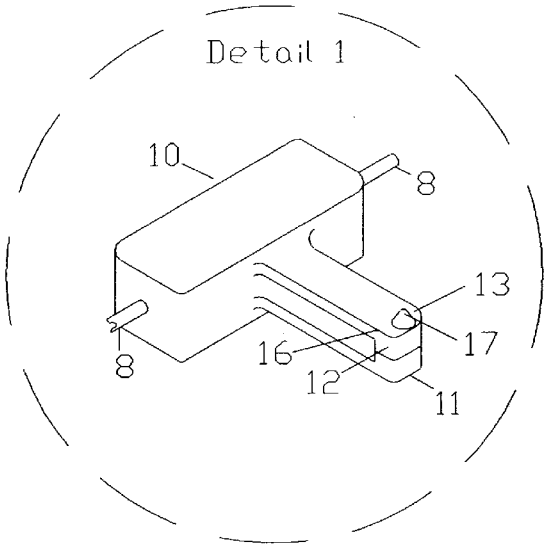
FIG. 6 is a detail of an element of subassembly 2 Item 2 in the closed position.

Referring to FIG. 6, a removed element Item 10 of subassembly 2 Item 2 is depicted to show the aluminum rod and to show the profile of the subassembly after it is removed from the mold. FIG. 4 is a removed section of subassembly 2 which shows the jaws of Item 10 open. The shape of this profile allows the subassemblies Item 2, Item 3, Item 4, Item 5, and Item 6 to clear the encapsulated aluminum rods Item 8. FIG. 4 also shows an anchor pin Item 13 with a dome shaped upset Item 17 and a hole Item 14. When Item 11 and Item 12 are joined, the result is a latch which confines the aluminum rod Item 8. Referring to FIG. 3, all of the jaws are shown to be fastened except subassembly 2 Item 2. The aluminum rod Item 8 has a smaller diameter than the slot formed when the jaws are closed. This allows each subassembly to pivot and stretch in the longitudinal and shift in the lateral direction. The optimum slot dimension and diameter of the aluminum rod can be found by experimenting with various prototypes.

Figure 5:
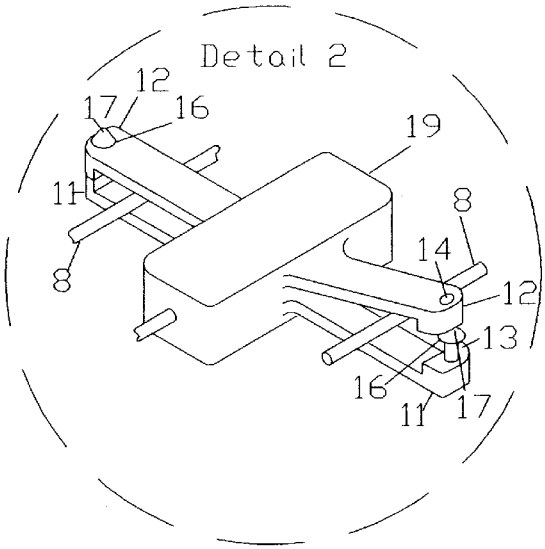
FIG. 5 is a detail of an element of subassembly 3 Item 4.

FIG. 5 shows an element Item 19 of the third subassembly 3 Item 4. This subassembly is a transition piece which requires (2) pair of jaws to connect the limb guard together. When the limb guard is installed on the knee, this piece would be located close to the center of the knee cap. This piece is shaped in a mold large enough to include the (3) categories of limb sizes and cut to the proper length. The transition profile includes an encapsulated aluminum rod and is formed in the same manner as subassembly 1 Item 1 and subassembly 2 Item 2.

Item 5 is formed using the same method as subassembly 2 Item 2. The only difference between these subassemblies is the nub Item 15. This subassembly is formed in the same mold as subassembly 2 Item 2 and cut leaving the (5) elements and the (2) nubs.

To assemble the limb guard of FIG. 3, the jaws of each element of subassembly 2 Item 2 are positioned to clear the aluminum rod Item 8 of subassembly 1 Item 1 (see FIG. 4). The upper jaw of each element is closed and secured against the lower jaws by the silicone anchor pins Item 13. The crown of each anchor pin Item 17 is aligned with its hole Item 14, and anchor pins are forced through the holes until the upper jaws are flush with the lower jaws. The dome shaped upsets at the end of the anchor pins called the crown deform inside the holes Item 14 and allow the upper jaws to close against the lower jaws. As the crown egresses, from the holes, the bill Item 16 of the crown begins to flare and secure the upper jaws against the lower jaws. The final profile of each element of subassembly 2 Item 2 would assume the shape illustrated in FIG. 6. In this manner, subassembly 2 Item 2 is connected to Item 1, Item 3 is connected to Item 2, Item 4 is connected to Item 3, Item 4 is connected to Item 5, Item 5 is connected to Item 6, and finally Item 6 is connected to Item 7. As mentioned above, the guard can be made longer by adding more subassemblies.

OPERATION

Figure 7:
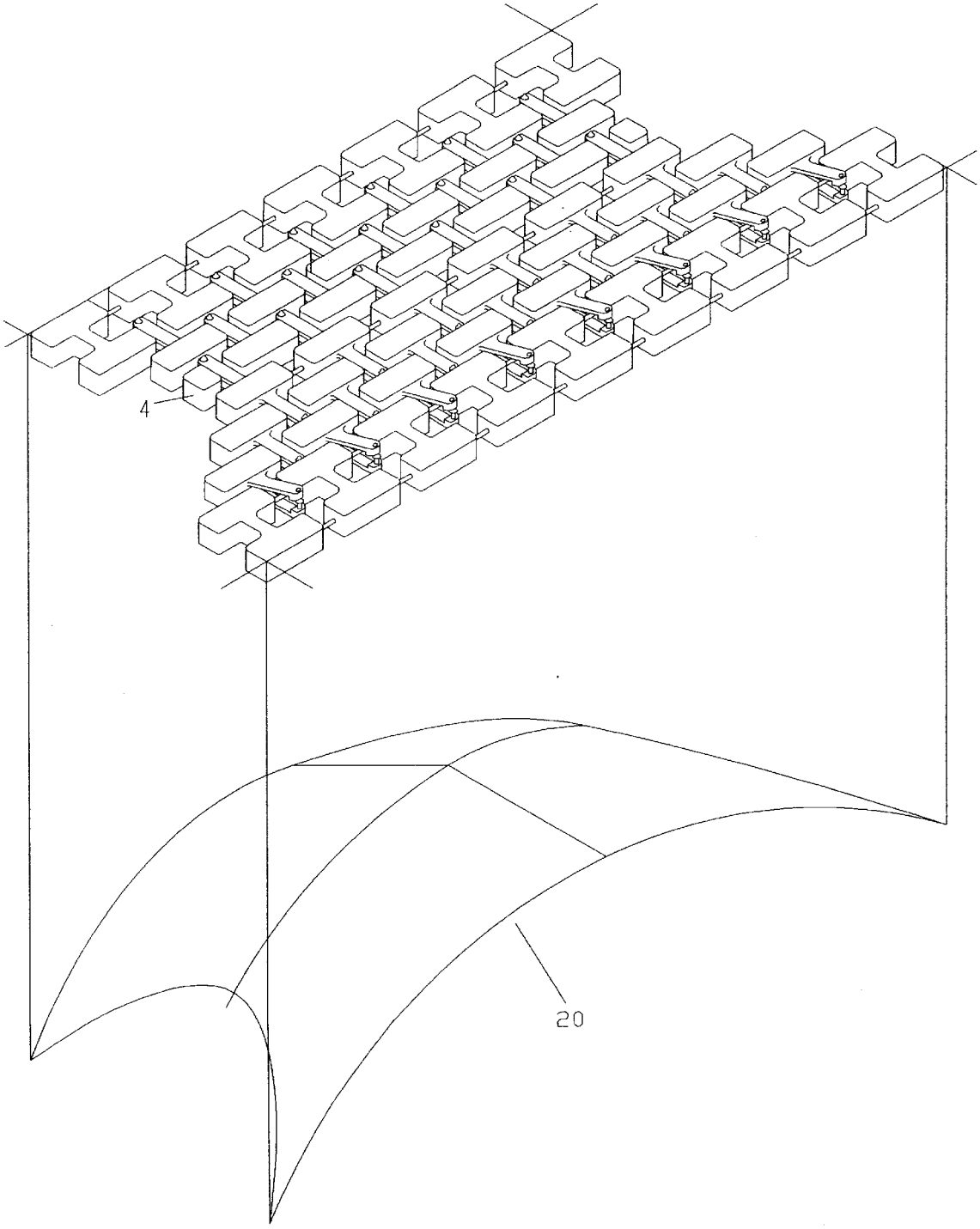
FIG. 7 is an isometric view of the guard describing the installation on the limb.

The limb guard is easy to install. Referring to FIG. 7, Item 20 represents the surface of the knee cap, a small portion of the lower thigh, and a small portion of the upper calf. The guard is placed over the knee or elbow with the transition piece Item 4 over the knee cap or elbow. By pressing on the guard from the top with the hands, the aluminum rods will deform until the guard conforms to the contour of the surface Item 20 in the lateral direction, and will stretch to conform to the surface in the longitudinal direction. The elements of the guard will sink into the surface or fabric, thereby securing the guard to the limb. If the limb guard is uncomfortable or too tight for the user, the guard can be slackened until the guard feels comfortable. Each of the items 1 through 7 have the ability to rotate and deflect independently. As the knee or elbow is flexed, the skin stretches more in the longitudinal direction carrying the corresponding item along and, consequently, the guard stretches in the longitudinal direction and changes its shape to match the shape of the limb. As the limb is straightened, the guard will shrink and change its shape to match the contour of the limb. The limb will also change its lateral dimension as the knee cycles through its extreme positions. Because the aluminum rods have the ability to deform repeatedly without breaking, the lateral deformation is absorbed by the aluminum rods.

CONCLUSIONS, RAMIFICATIONS, AND SCOPE OF INVENTION

Thus the reader will see that this limb guard provides a comfortable, flexible, adjustable, and easily manufactured device which can be used by athletes to protect their joints.

While my above description contains many specifics, these should not be construed as limitations on the scope of the invention, but rather as an exemplification of one preferred embodiment thereof. Many variations are possible. For example, the guard could be used as a protection for the heels and elbows of bed-ridden patients for the prevention or treatment of decubitus ulcers or bed sores. The only modification necessary would be the shape of the guard to resemble the contour of the area to be protected. The device could be modified to replace the resilient material inside helmets and safety hats. Instead of using aluminum rods, a spring steel could be encapsulated in the silicone so that after impact, the guard would return to its original shape. The garment could have a hook and loop substitute laminated to the fabric of the pants and the hook bonded to the pad. The pad could then be attached to the pants. The pants might resemble riding pants that bicyclists wear or running tights. This arrangement could be used on most of the prior art references referred to in this specification. The pads used in football gear such as knee pads, shoulder pads, thigh pads, neck rolls, body pads, and polar pads could be replaced with this guard. This would allow the padding to conform more to the shape of the body. The guard could be used as an innersole to allow the foot contour to match the shoe contour. The guard can be made with a an elastic strip and an integral aluminum rod replacing the hinged elements. This modification would further simplify the manufacture of this device. The same idea could be used for the bottoms of chairs and mattresses. The supporting device would conform more to the shape of the body and gluteus maximus. The strips could then be fastened together with inserts and guides.

Accordingly, the scope of the invention should be determined not by the embodiment illustrated, but by the appended claims and their legal equivalents.

I claim:

1. A limb guard to protect the joints comprising:

a plurality of articulated strips made from a plurality of resilient elements, which are joined together by an integral malleable element and said resilient elements have a plurality of integral fastening means capable of both securing one said strip to another said strip to form said limb guard and allows said strips to both rotate and move laterally and longitudinally relative to each other.

2. A limb guard to protect the joints comprising:

a plurality of strips made from a resilient material, which have an integral malleable element and said strips have a plurality of integral fastening means capable of both securing one said strip to another said strip to form said limb guard and allows said strips to both rotate and move both laterally and longitudinally relative to each other.

* * * * *